US012378498B2

(12) United States Patent
Inda et al.

(10) Patent No.: US 12,378,498 B2
(45) Date of Patent: Aug. 5, 2025

(54) GREASE COMPOSITION

(71) Applicant: IDEMITSU KOSAN CO., LTD., Chiyoda-ku (JP)

(72) Inventors: Keisuke Inda, Chiyoda-ku (JP); Go Watanabe, Chiyoda-ku (JP); Kouji Takane, Chiyoda-ku (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 18/550,984

(22) PCT Filed: Mar. 31, 2022

(86) PCT No.: PCT/JP2022/016960
§ 371 (c)(1),
(2) Date: Sep. 18, 2023

(87) PCT Pub. No.: WO2022/211117
PCT Pub. Date: Oct. 6, 2022

(65) Prior Publication Data

US 2024/0174942 A1 May 30, 2024

(30) Foreign Application Priority Data

Mar. 31, 2021 (JP) ..... 2021-062412

(51) Int. Cl.
*C10M 169/02* (2006.01)
*C10M 115/08* (2006.01)
(Continued)

(52) U.S. Cl.
CPC ..... *C10M 169/02* (2013.01); *C10M 115/08* (2013.01); *C10M 143/04* (2013.01);
(Continued)

(58) Field of Classification Search
CPC ..... C10M 169/02; C10M 143/04; C10M 169/06; C10M 171/06; C10M 2205/024;
(Continued)

(56) References Cited

U.S. PATENT DOCUMENTS

2006/0052261 A1 3/2006 Kray et al.
2010/0197540 A1* 8/2010 Shan ..... C10M 143/00 508/591

(Continued)

FOREIGN PATENT DOCUMENTS

JP 2006-70262 A 3/2006
JP 2011-148908 A 8/2011

(Continued)

OTHER PUBLICATIONS

International Search Report issued on Jun. 7, 2022 in PCT/JP2022/016960 (with English translation), 7 pages.

(Continued)

*Primary Examiner* — Prem C Singh
*Assistant Examiner* — Francis C Campanell
(74) *Attorney, Agent, or Firm* — Oblon, McClelland, Maier & Neustadt, L.L.P.

(57) ABSTRACT

A grease composition, containing a base oil (A), a urea-based thickener (B), and a polymer compound (C). The particles that make up the urea-based thickener (B) in the grease composition satisfy the following requirement (I): the particles have an arithmetic average particle diameter on an area basis as measured by a laser diffraction/scattering method of 2.0 μm or less, and the polymer compound (C) has a number average molecular weight (Mn) of 30,000 or more and a molecular weight distribution (Mw/Mn) of 2.20 or less.

20 Claims, 3 Drawing Sheets

(51) Int. Cl.

| | |
|---|---|
| ***C10M 143/04*** | (2006.01) |
| ***C10M 169/06*** | (2006.01) |
| ***C10M 171/06*** | (2006.01) |
| *C10N 20/02* | (2006.01) |
| *C10N 20/04* | (2006.01) |
| *C10N 40/04* | (2006.01) |

(52) U.S. Cl.
CPC ..... *C10M 169/06* (2013.01); *C10M 171/06* (2013.01); *C10M 2205/024* (2013.01); *C10M 2215/28* (2013.01); *C10M 2290/10* (2013.01); *C10N 2020/02* (2013.01); *C10N 2020/04* (2013.01); *C10N 2040/04* (2013.01)

(58) Field of Classification Search
CPC ..... C10M 2215/28; C10M 2290/10; C10M 161/00; C10M 2205/02; C10M 2215/1026; C10N 2020/02; C10N 2020/04; C10N 2040/04; C10N 2020/06; C10N 2050/10
USPC ..... 508/552

See application file for complete search history.

(56) References Cited

U.S. PATENT DOCUMENTS

| | | | | |
|---|---|---|---|---|
| 2013/0331306 | A1* | 12/2013 | Aida | C10M 169/04 508/409 |
| 2017/0362530 | A1 | 12/2017 | Hirooka et al. | |
| 2018/0037842 | A1* | 2/2018 | Suetsugu | B01J 19/1806 |
| 2018/0216026 | A1 | 8/2018 | Asai | |
| 2021/0095219 | A1 | 4/2021 | Watanabe et al. | |
| 2022/0135897 | A1 | 5/2022 | Shishikura | |
| 2022/0145203 | A1 | 5/2022 | Watanabe | |
| 2022/0162513 | A1 | 5/2022 | Shishikura | |

FOREIGN PATENT DOCUMENTS

| | | | |
|---|---|---|---|
| JP | 2017-109644 | A | 6/2017 |
| JP | 2018-119090 | A | 8/2018 |
| WO | WO 2016/104812 | A1 | 6/2016 |
| WO | WO 2019/044624 | A1 | 3/2019 |
| WO | WO 2020/179589 | A1 | 9/2020 |
| WO | WO 2020/179595 | A1 | 9/2020 |
| WO | WO 2020/179603 | A1 | 9/2020 |

OTHER PUBLICATIONS

Written Opinion issued on Jun. 7, 2022 in PCT/JP2022/016960 (with English translation), 8 pages.

* cited by examiner

GREASE COMPOSITION

CROSS REFERENCE TO RELATED APPLICATIONS

This application is a National Stage entry under 35 U.S.C. § 371 of PCT/JP2022/016960, filed on Mar. 31, 2022, and claims priority to Japanese Patent Application No. 2021-062412, filed on Mar. 31, 2021. The entire contents of both are incorporated herein by reference.

TECHNICAL FIELD

The present invention relates to a grease composition.

BACKGROUND ART

A grease composition is easy to achieve sealing as compared with lubricating oils and is able to achieve downsizing and weight reduction of a machine to be applied. Accordingly, the grease composition has hitherto been widely used for lubrication of a variety of sliding portions of automobiles, electrical machinery and appliances, industrial machinery, industrial machines, and so on.

In recent years, from the viewpoints of weight reduction, silence, and the like, use of a resin material as a member of a sliding portion has been examined.

For example, in a worm gear of electric power steering (EPS) of automobiles, the material of a worm is typically a metal from the viewpoint of strength. On the other hand, as a material of a worm wheel, a resin is used in many cases from the viewpoint of reducing the weight of automobile components, preventing abrasive noise (silence), such as tooth-striking noise due to contact with a worm or vibration noise, and preventing seizure with a worm. A known example of the resin used is a polyamide resin.

EPS is a mechanism to assist steering of turning of a handle when an automobile runs at a low speed. On the other hand, when an automobile runs at a high speed, a centrifugal force is exerted on the automobile in turning and the automobile can be turned by very small steering of the handle. Accordingly, the automobile is controlled so that the assist by EPS does not act in running at a high speed.

Thus, the action of a worm gear when the assist does not act is at a lower speed and under a lower load than in the state with the assist. Accordingly, there is a need for a grease composition that can be suited to lubrication of a sliding portion composed of a metal material of a worm and the like and a resin material of a worm wheel and the like even under conditions of low speed and low load.

For example, PTL 1 discloses a grease composition based on a problem of reducing the steering torque in the state without the EPS assist.

CITATION LIST

Patent Literature

PTL1: WO 2016/104812

SUMMARY OF INVENTION

Technical Problem

For a worm gear, an increase in the life of a resin material is also desired. For this sake, in sliding between a metal material and a resin material, a phenomenon that the strain of the resin material increases (creep) due to a load exerted on the resin material for a long period of time is to be suppressed. In particular, a resin material is more likely to transform under an environment of a higher temperature.

Thus, for suppressing the creep to increase the life of a resin material, suppression of frictional heat, namely, reduction of friction coefficient, is important.

In recent years, for increasing the life of a resin material, as a material of a worm wheel, a resin in which glass fibers are blended to enhance the strength has been used.

In a reinforced resin containing glass fibers, the glass fibers tend to be vertically oriented on the surface and the like of the resin, and thus, the glass fibers scratch a metal surface in contact with the worm, resulting in an increase in the friction coefficient. Accordingly, there is a need for a grease composition that can also be suited to lubrication of a sliding portion composed of a metal material and such a resin material that has a different performance from conventional resin materials.

However, in the grease composition of PTL 1, a performance of lubrication between a resin material, such as a reinforced resin material containing glass fibers, different from conventional resin materials and a metal material has not been studied at all, and the frictional characteristics have sometimes become insufficient with a transition in resin materials.

Thus, the present invention has an object to provide a grease composition that is superior in reduction of friction coefficient under conditions of low speed and low load.

Solution to Problem

In a grease composition containing a base oil and a urea-based thickener, the present inventors focused on a particle diameter of particles containing the urea-based thickener in the grease composition. Then, it has been found that a grease composition in which the particles are regulated such that an arithmetic average particle diameter on an area basis as measured by a laser diffraction/scattering method falls within a prescribed range and which contains a specific polymer compound is able to solve the aforementioned problem, thereby leading to accomplishment of the present invention.

Specifically, the present invention relates to the following [1].

[1] A grease composition, containing:
- a base oil (A);
- a urea-based thickener (B); and
- a polymer compound (C),
- wherein particles that contain the urea-based thickener (B) in the grease composition satisfying the following requirement (I):
- requirement (I): the particles have an arithmetic average particle diameter on an area basis as measured by a laser diffraction/scattering method of 2.0 μm or less, and
- the polymer compound (C) having a number average molecular weight (Mn) of 30,000 or more and a molecular weight distribution (Mw/Mn) of 2.20 or less.

Advantageous Effects of Invention

According to the present invention, it is possible to provide a grease composition that is superior in reduction of friction coefficient under conditions of low speed and low load.

DESCRIPTION OF EMBODIMENTS

Figure 1:
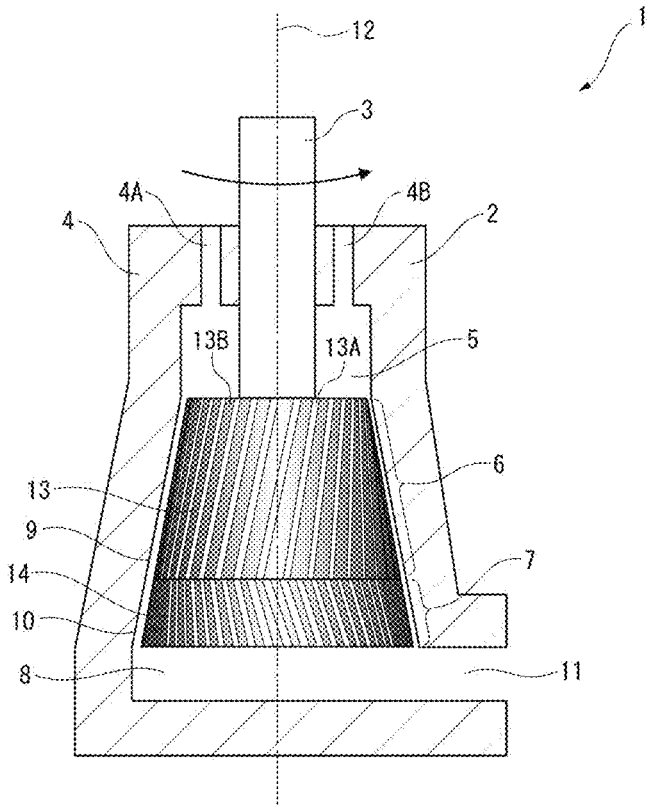
FIG. 1 is a schematic cross-sectional view of a grease manufacturing apparatus to be used in an embodiment of the present invention.

In this description, regarding a preferred numerical value range (for example, a range of a content or the like), lower limit values and upper limit values that are expressed stepwise can be each independently combined. For example, from an expression of "preferably 10 to 90, and more preferably 30 to 60", the "preferred lower limit value (10)" and the "more preferred upper limit value (60)" can be combined to make a range "10 to 60".

In this description, a numerical value in Examples is the numerical value that can be used as an upper limit value or a lower limit value.

In this description, a mass average molecular weight (Mw) and a number average molecular weight (Mn) of each component are values based on polystyrene standards as measured by a gel permeation chromatography (GPC) method, and specifically, values as measured by a method described in of Examples.

In this description, for example, "(meth)acrylate" is used as a term indicating both of "acrylate" and "methacrylate", and the same applies to other similar terms and similar expressions.

[Grease Composition]

The grease composition of the present invention is a grease composition that contains a base oil (A), a urea-based thickener (B), and a polymer compound (C), particles that contain the urea-based thickener (B) in the grease composition satisfying the following requirement (I), the polymer compound (C) having a number average molecular weight (Mn) of 30,000 or more and a molecular weight distribution (Mw/Mn) of 2.20 or less.

Requirement (I): the particles have an arithmetic average particle diameter on an area basis as measured by a laser diffraction/scattering method of 2.0 μm or less.

In the following description, "base oil (A)", "urea-based thickener (B)", and "polymer compound (C)" are also referred to as "component (A)", "component (B)", and "component (C)", respectively.

In the grease composition of an embodiment of the present invention, the total content of the component (A), the component (B), and the component (C) based on the total amount (100% by mass) of the grease composition is preferably 60% by mass or more, more preferably 70% by mass or more, further preferably 80% by mass or more, still further preferably 90% by mass or more, and is typically 100% by mass or less, preferably less than 100% by mass, more preferably 99% by mass or less, further preferably 98% by mass or less.

The grease composition of an embodiment of the present invention may contain a component other than the components (A), (B), and (C) to the extent that the effect of the present invention is not impaired.

As a result of extensive and intensive studies of the present inventors for solving the above problem, it has been found that, when the polymer compound (C) in the grease composition has a number average molecular weight (Mn) of 30,000 or more and also has a molecular weight distribution (Mw/Mn) of 2.20 or less, a grease composition superior in reduction of friction coefficient can be obtained.

Specifically, the present inventors have found the followings.

In a polymer compound, compounds having a variety of molecular weights, from a low molecular weight compound to a high molecular weight compound depending on the degree of polymerization, are present together. Then, as the molecular weight distribution (Mw/Mn) of the polymer compound is a smaller value, an abundance ratio of molecules having specific molecular weights is higher and an abundance ratio of compounds having other molecular weights is lower. In other words, as the molecular weight distribution (Mw/Mn) of the polymer compound is a smaller value, the molecular weights are more uniform around a specific molecular weight and the sizes of the molecules can be closer to a uniform size.

The present inventors have guessed that, when the number average molecular weight (Mn) of the polymer compound in the grease composition is 30,000 or more and the molecular weight distribution (Mw/Mn) of the polymer compound is 2.20 or less, in the grease composition, polymer compounds having higher molecular weights are superposed on one another in a bulky manner (in other words, polymer compounds having higher molecular weights are superposed on one another in a rough state containing many voids), and thus, the polymer compounds cause an elastic force. The present inventors have also guessed that, in the grease composition, the elastic force of the polymer compound pushes up the interface of friction, leading to an increase in oil film thickness of the base oil. As a result, the present inventors have found that the friction coefficient can be reduced.

Meanwhile, when the molecular weight distribution (Mw/Mn) of the polymer compound is more than 2.20, compounds having various molecular weights, from a low molecular weight to a high molecular weight, are present together. It may be guessed that, since smaller particles hence easily enter voids between larger particles, the polymer compounds are superposed in a close state, the oil film thickness of the base oil is insufficient, and the frictional characteristics are also not sufficient.

Even with the molecular weight distribution (Mw/Mn) of the polymer compound of 2.20 or less, when the number average molecular weight (Mn) of the polymer compound is less than 30,000, it may be guessed that, since smaller particles are superposed on one another, the oil film thickness of the base oil is insufficient and the frictional characteristics are also not sufficient.

<Requirement (I)>

In the grease composition of the present invention, particles that contain the urea-based thickener (B) in the grease composition satisfies the following requirement (I).

Requirement (I): the particles have an arithmetic average particle diameter on an area basis as measured by a laser diffraction/scattering method of 2.0 μm or less.

By satisfying the requirement (I), a grease composition superior in reduction of friction coefficient can be obtained.

The requirement (I) is also considered as a parameter expressing a state of aggregation of the urea-based thickener (B) in the grease composition.

Here, the term "particles that contain the urea-based thickener (B)" as an object to be measured by the laser diffraction/scattering method refers to particles in which the urea-based thickener (B) contained in the grease composition aggregates.

In the case where an additive other than the urea-based thickener (B) is contained in the grease composition, the particle diameter defined in the requirement (I) can be obtained through measurement of a grease composition prepared under the same conditions without blending the additive by the laser diffraction/scattering method. However, in the case where the additive is liquid at room temperature (25° C.), or in the case where the additive is dissolved in the base oil (A), it does not matter if a grease composition having the additive blended therein is an object to be measured.

The urea-based thickener (B) is typically obtained by reacting an isocyanate compound with a monoamine. However, since the reaction rate is very fast, the urea-based thickener (B) aggregates, whereby large particles (micelle particles, so-called "lumps") are liable to be formed in excess. As a result of intensive investigations made by the present inventor, it has been found that when the particle diameter defined in the requirement (I) is more than 2.0 μm, frictional characteristics of the grease composition cannot be secured in the case of increasing worked penetration of the grease composition. That is, it has been found that, when the particle diameter defined in the requirement (I) is more than 2.0 μm, even with the specific polymer compound (C), it is difficult to obtain a grease composition superior in frictional characteristics.

In contrast, as a result of intensive studies by the present inventors, it has been found that, by reducing the particle diameter defined in the requirement (I) to 2.0 μm or less, a grease composition superior in frictional characteristics can be obtained by combination with the specific polymer compound (C).

It may be guessed that this effect is brought by the fact that by miniaturizing the particle diameter defined in the requirement (I) to 2.0 μm or less, the particles containing the urea-based thickener (B) becomes easy to come into a lubricating site (frictional surface) of a worm gear or the like and are hardly removed from the lubricating site, whereby a holding power of the grease composition in the lubricating site is improved. In addition, by miniaturizing the particle diameter defined in the requirement (I) to 2.0 μm or less, the holding power of the base oil (A) by the foregoing particles is improved. Accordingly, it may be guessed that not only the base oil (A) is spread well in the lubricating site (frictional surface) of a worm gear or the like, but also, in association with this, an action to spread well the polymer compound (C) in the lubricating site is improved, whereby the frictional characteristics are improved, too.

From the aforementioned viewpoint, in the grease composition of an embodiment of the present invention, the particle diameter defined in the requirement (I) is preferably 1.5 μm or less, more preferably 1.0 μm or less, further preferably 0.9 μm or less, still further preferably 0.8 μm or less, furthermore preferably 0.7 μm or less, still furthermore preferably 0.6 μm or less, yet still furthermore preferably 0.5 μm or less, and even yet still furthermore preferably 0.4 μm or less. The particle diameter is typically 0.01 μm or more.

<Requirement (II)>

Here, it is preferred that the grease composition of an embodiment of the present invention further satisfies the following requirement (II).

Requirement (II): the particles have a specific surface area as measured by a laser diffraction/scattering method of $0.5\times10^5$ $cm^2/cm^3$ or more.

The specific surface area defined in the requirement (II) is a secondary index expressing a state of miniaturization of the particles containing the urea-based thickener (B) in the grease composition and presence of large particles (lumps). That is, satisfying the requirement (I) while further satisfying the requirement (II) represents that the state of miniaturization of the particles containing the urea-based thickener (B) in the grease composition is more favorable and that the presence of large particles (lumps) is more suppressed. Accordingly, a grease composition that is superior in frictional characteristics and that easily exhibits the effect of the polymer compound (C) can be obtained.

From the aforementioned viewpoint, the specific surface area defined in the requirement (II) is preferably $0.7\times10^5$ $cm^2/cm^3$ or more, more preferably $0.8\times10^5$ $cm^2/cm^3$ or more, further preferably $1.2\times10^5$ $cm^2/cm^3$ or more, still further preferably $1.5\times10^5$ $cm^2/cm^3$ or more, furthermore preferably $1.8\times10^5$ $cm^2/cm^3$ or more, and still furthermore preferably $2.0\times10^5$ $cm^2/cm^3$ or more. The specific surface area is typically $1.0\times10^6$ $cm^2/cm^3$ or less.

In this description, the values defined in the requirement (I) and further the requirement (II) are values measured by the method described in of Examples as mentioned later.

The values defined in the requirement (I) and further the requirement (II) are able to be adjusted chiefly by production conditions of the urea-based thickener (B).

The components which are contained in the grease composition of the present invention are hereunder described in detail while focusing on a specific means for adjusting the values defined in the requirement (I) and further the requirement (II).

<Base Oil (A)>

As the base oil (A) contained in the grease composition of the present invention, one or more selected from mineral oils and synthetic oils may be used.

Examples of the mineral oils include a distillate oil obtained by atmospheric distillation or vacuum distillation of paraffinic crude oil, intermediate base crude oil, or naphthenic crude oil, and a refined oil obtained by refining such a distillate oil according to a conventional method.

Examples of the refining process include solvent dewaxing treatment, hydroisomerization treatment, hydrofinishing treatment, and clay treatment.

Examples of the synthetic oil include a hydrocarbon oil, an aromatic oil, an ester oil, an ether oil, and a synthetic oil obtained by isomerizing a wax (GTL wax) produced by Fischer-Tropsch process or the like.

Examples of the hydrocarbon oil include normal paraffin, iso-paraffin, poly-α-olefins (PAO), such as polybutene, polyisobutylene, a 1-decene oligomer, and a 1-decene-ethylene co-oligomer, and a hydrogenation product thereof.

Examples of the aromatic oil include alkylbenzenes, such as monoalkylbenzene and dialkylbenzene; alkylnaphthalenes, such as monoalkylnaphthalene, dialkylnaphthalene, and polyalkylnaphthalene.

Examples of the ester oil include diester oils, such as dibutyl sebacate, di-2-ethylhexyl sebacate, dioctyl adipate, diisodecyl adipate, ditridecyl adipate, ditridecyl glutarate, and methyl acetyl ricinoleate; aromatic ester oils, such as trioctyl trimellitate, tridecyl trimellitate, and tetraoctyl pyromelitate; polyol ester oils, such as trimethylolpropane caprylate, trimethylolpropane pelargonate, pentaerythritol-2-ethylhexanoate, and pentaerythritol pelargonate; and a complex ester oil, such as an oligoester of a polyhydric alcohol and a mixed fatty acid of a dibasic acid and a monobasic acid.

Examples of the ether oil include polyglycols, such as polyethylene glycol, polypropylene glycol, polyethylene glycol monoether, and polypropylene glycol monoether; phenyl ether oils, such as monoalkyl triphenyl ether, alkyl diphenyl ether, dialkyl diphenyl ether, pentaphenyl ether, tetraphenyl ether, monoalkyl tetraphenyl ether, and dialkyl tetraphenyl ether.

The base oil (A) of this embodiment has a 40° C. kinematic viscosity of preferably 10 $mm^2/s$ or more, more preferably 15 $mm^2/s$ or more, further preferably 20 $mm^2/s$ or more. When the 40° C. kinematic viscosity of the base oil (A) is 10 $mm^2/s$ or more, the effect of the present invention is easily exhibited.

The base oil (A) of this embodiment has a 40° C. kinematic viscosity of preferably 150 $mm^2/s$ or less, more preferably 130 $mm^2/s$ or less, further preferably 110 $mm^2/s$ or less, still further preferably 100 $mm^2/s$ or less. When the 40° C. kinematic viscosity of the base oil (A) is 150 $mm^2/s$ or less, the effect of the present invention is more easily exhibited.

The upper limits and the lower limits of the numerical ranges can be arbitrarily combined. Specifically, the 40° C. kinematic viscosity is preferably 10 to 150 $mm^2/s$, more preferably 10 to 130 $mm^2/s$, further preferably 15 to 110 $mm^2/s$, still further preferably 20 to 100 $mm^2/s$.

The base oil (A) used in an embodiment of the present invention may be a mixed base oil having a kinematic viscosity adjusted within the above range by combining a base oil having a high viscosity and a base oil having a low viscosity.

A viscosity index of the base oil (A) which is used in an embodiment of the present invention is preferably 80 or more, more preferably 100 or more, and further preferably 120 or more.

In this description, the kinematic viscosity and the viscosity index each mean a value measured or calculated according to JIS K2283:2000.

In the grease composition according to an embodiment of the present invention, the content of the base oil (A) is preferably 50% by mass or more, more preferably 55% by mass or more, further preferably 60% by mass or more, and still further preferably 65% by mass or more, and is preferably 98.5% by mass or less, more preferably 97% by mass or less, further preferably 95% by mass or less, and still further preferably 93% by mass or less, based on the total amount (100% by mass) of the grease composition.

<Urea-Based Thickener (B)>

The urea-based thickener (B) contained in the grease composition of the present invention may be any compound that has a urea bond, but is preferably a diurea compound having two urea bonds, and more preferably a diurea compound represented by the following general formula (b1).

$$R^1—NHCONH—R^3—NHCONH—R^2 \quad (b1)$$

The urea-based thickener (B) used in an embodiment of the present invention may be composed of one compound or may be a mixture of two or more compounds.

In the general formula (b1), $R^1$ and $R^2$ each independently represent a monovalent hydrocarbon group having 6 to 24 carbon atoms, and $R^1$ and $R^2$ may be the same as or different from each other. $R^3$ represents a divalent aromatic hydrocarbon group having 6 to 18 carbon atoms.

The carbon number of the monovalent hydrocarbon group that can be selected as $R^1$ and $R^2$ in the general formula (b1) is 6 to 24, but it is preferably 6 to 20, and more preferably 6 to 18.

Examples of the monovalent hydrocarbon group that can be selected as $R^1$ and $R^2$ include a saturated or an unsaturated monovalent chain hydrocarbon group, a saturated or an unsaturated monovalent alicyclic hydrocarbon group, and a monovalent aromatic hydrocarbon group.

Here, in $R^1$ and $R^2$ in the general formula (b1), when the content rate of the chain hydrocarbon group is designated as an X molar equivalent, the content rate of the alicyclic hydrocarbon group is designated as a Y molar equivalent, and the content rate of the aromatic hydrocarbon group is designated as a Z molar equivalent, it is preferred that the following requirements (a) and (b) are satisfied.

Requirement (a):

A value of $[(X+Y)/(X+Y+Z)]\times100$ is 90 or more (preferably 95 or more, more preferably 98 or more, and further preferably 100).

Requirement (b):

An X/Y ratio is 0/100 (X=0, Y=100) to 100/0 (X=100, Y=0) (preferably 10/90 to 90/10, more preferably 80/20 to 20/80, and further preferably 70/30 to 40/60).

Since the aforementioned alicyclic hydrocarbon group, the aforementioned chain hydrocarbon group, and the aforementioned aromatic hydrocarbon group are each a group to be selected as $R^1$ and $R^2$ in the general formula (b1), the sum total of the X, Y, and Z values is 2 molar equivalents per mol of the compound represented by the general formula (b1). In addition, the values of the requirements (a) and (b) each mean an average value taken over the total amount of a group of the compounds represented by the general formula (b1), which is contained in the grease composition.

By using the compound represented by the general formula (b1) that satisfies the requirements (a) and (b), it is easy to provide a grease composition superior in low temperature characteristics.

The X, Y, and Z values can be calculated from a molar equivalent of each amine to be used as a raw material.

Examples of the monovalent saturated chain hydrocarbon group include linear or branched alkyl groups having 6 to 24 carbon atoms, and specific examples include a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, an octadecenyl group, a nonadecyl group, and an icosyl group.

Examples of the monovalent unsaturated chain hydrocarbon group include linear or branched alkenyl groups having 6 to 24 carbon atoms, and specific examples include a hexenyl group, a heptenyl group, an octenyl group, a nonenyl group, a decenyl group, an undecenyl group, a dodecenyl group, a tridecenyl group, a tetradecenyl group, a pentadecenyl group, a hexadecenyl group, a heptadecenyl group, an octadecenyl group, a nonadecenyl group, an icosenyl group, an oleyl group, a geranyl group, a farnesyl group, and a linoleyl group.

The monovalent saturated chain hydrocarbon group and the monovalent unsaturated chain hydrocarbon group may be a linear group or a branched group.

Examples of the monovalent saturated alicyclic hydrocarbon group include cycloalkyl groups, such as a cyclohexyl group, a cycloheptyl group, a cyclooctyl group, and a cyclononyl group; and cycloalkyl groups substituted with an alkyl group having 1 to 6 carbon atoms (preferably cyclohexyl groups substituted with an alkyl group having 1 to 6 carbon atoms), such as a methylcyclohexyl group, a dimethylcyclohexyl group, an ethylcyclohexyl group, a diethylcyclohexyl group, a propylcyclohexyl group, an isopropylcyclohexyl group, a 1-methyl-propylcyclohexyl group, a butylcyclohexyl group, a pentylcyclohexyl group, a pentylmethylcyclohexyl group, and a hexylcyclohexyl group.

Examples of the monovalent unsaturated alicyclic hydrocarbon group include cycloalkenyl groups, such as a cyclohexenyl group, a cycloheptenyl group, and a cyclooctenyl group; and cycloalkenyl groups substituted with an alkyl group having 1 to 6 carbon atoms (preferably a cyclohexenyl group substituted with an alkyl group having 1 to 6 carbon atoms), such as a methylcyclohexenyl group, a dimethylcyclohexenyl group, an ethylcyclohexenyl group, a diethylcyclohexenyl group, and a propylcyclohexenyl group.

Examples of the monovalent aromatic hydrocarbon group include a phenyl group, a biphenyl group, a terphenyl group, a naphthyl group, a diphenylmethyl group, a diphenylethyl group, a diphenylpropyl group, a methylphenyl group, a dimethylphenyl group, an ethylphenyl group, and a propylphenyl group.

Although the carbon number of the divalent aromatic hydrocarbon group which can be selected as $R^3$ in the general formula (b1) is 6 to 18, preferably 6 to 15, and more preferably 6 to 13.

Examples of the divalent aromatic hydrocarbon group which can be selected as $R^3$ include a phenylene group, a diphenylmethylene group, a diphenylethylene group, a diphenylpropylene group, a methylphenylene group, a dimethylphenylene group, and an ethylphenylene group.

Among them, a phenylene group, a diphenylmethylene group, a diphenylethylene group, or a diphenylpropylene group is preferred, and a diphenylmethylene group is more preferred.

In the grease composition according to an embodiment of the present invention, the content of the component (B) is preferably 1.0 to 15.0% by mass, more preferably 1.5 to 13.0% by mass, further preferably 2.0 to 10.0% by mass, still further preferably 2.5 to 8.0% by mass, and furthermore preferably 4.0% by mass to 7.0% by mass based on the total amount (100% by mass) of the grease composition.

When the content of component (B) is 1.0% by mass or more, it is easy to adjust the worked penetration of the resulting grease composition to a suitable range.

Meanwhile, when the content of the component (B) is 15.0% by mass or less, the resulting grease composition can be adjusted to be soft, and therefore, it is easy to make the lubricating properties favorable, and the friction characteristics are readily improved.

<Method for Producing Urea-Based Thickener (B)>

The urea-based thickener (B) can be typically obtained by reacting an isocyanate compound with a monoamine. The reaction is preferably performed by adding a solution β obtained by dissolving the monoamine in the base oil (A) to a heated solution a obtained by dissolving the isocyanate compound in the base oil (A).

For example, in the case where a compound represented by the general formula (b1) is synthesized, a diisocyanate having a group corresponding to a divalent aromatic hydrocarbon group represented by $R^3$ in the general formula (b1) is used as an isocyanate compound, and an amine having a group corresponding to a monovalent hydrocarbon group represented by $R^1$ and $R^2$ is used as a monoamine, whereby a desired urea-based thickener (B) can be synthesized according to the aforementioned method.

From the viewpoint of miniaturizing the urea-based thickener (B) in the grease composition so as to satisfy the requirement (I) and further the requirement (II), it is preferred to produce a grease composition containing the component (A) and the component (B) by using a grease manufacturing apparatus as expressed in the following [1].

[1] A grease manufacturing apparatus including a container body having an introduction portion through which a grease raw material is introduced and a discharge portion through which a grease is discharged to the outside; and a rotor having a rotation axis in an axial direction of an inner periphery of the container body and rotatably provided in the inside of the container body, the rotor including a first concave-convex portion in which (i) concaves and convexes are alternately provided along a surface of the rotor, the concaves and convexes being inclined with respect to the rotation axis, and (ii) a feeding ability in a direction of from the introduction portion to the discharge portion is provided.

While the grease manufacturing apparatus as set forth in the above [1] is hereunder described, the prescription with the term "preferred" in the statement below is an embodiment provided from the viewpoint of miniaturizing the urea-based thickener (B) in the grease composition so as to satisfy the requirement (I) and further the requirement (II), unless otherwise specifically indicated.

FIG. 1 is a schematic cross-sectional view of the grease manufacturing apparatus as set forth in the above [1] that can be used in an embodiment of the present invention.

A grease manufacturing apparatus 1 shown in FIG. 1 includes a container body 2 inside which a grease raw material is introduced; and a rotor 3 having a rotation axis 12 on a center axis line of an inner periphery of the container body 2 and rotating around the rotation axis 12 as a center axis.

The rotor 3 rotates at high speed around the rotation axis 12 as a center axis to apply a high shearing force to a grease raw material inside the container body 2. Thus, a grease containing the urea-based thickener (B) is produced.

As shown in FIG. 1, the container body 2 is preferably partitioned into an introduction portion 4, a retention portion 5, a first inner peripheral surface 6, a second inner peripheral surface 7, and a discharge portion 8 in this order from the upstream side.

As shown in FIG. 1, it is preferred that the container body 2 has an inner peripheral surface forming such a truncated cone shape that an inner diameter thereof gradually increases from the introduction portion 4 toward the discharge portion 8.

The introduction portion 4 serving as one end of the container body 2 is provided with a plurality of solution introducing pipes 4A and 4B for introducing a grease raw material from the outside of the container body 2.

The retention portion 5 is disposed in a downstream portion of the introduction portion 4, and is a space for temporarily retaining the grease raw material introduced from the introduction portion 4. When the grease raw material is retained in the retention portion 5 for a long time, grease adhering to an inner peripheral surface of the retention portion 5 forms a large lump. Thus, it is preferred to transport the grease raw material to the first inner peripheral surface 6 on the downstream side in an as short as possible time. More preferably, it is preferred to transport the grease raw material directly to the first inner peripheral surface 6 without passing through the retention portion 5.

The first inner peripheral surface 6 is disposed in a downstream portion adjacent to the retention portion 5, and the second inner peripheral surface 7 is disposed in a downstream portion adjacent to the first inner peripheral surface 6. As mentioned later in detail, it is preferred to provide a first concave-convex portion 9 on the first inner peripheral surface 6 and to provide a second concave-convex portion 10 on the second inner peripheral surface 7, for the purpose of allowing the first inner peripheral surface 6 and the second inner peripheral surface 7 to function as a high shearing portion for imparting a high shearing force to the grease raw material or grease.

The discharge portion 8 serving as the other end of the container body 2 is a part for discharging the grease agitated on the first inner peripheral surface 6 and a second inner peripheral surface 7, and is provided with a discharge port 11 for discharging the grease. The discharge port 11 is formed in the direction orthogonal to or a direction approximately orthogonal to the rotation axis 12. According to this, the grease is discharged from the discharge port 11 in the direction orthogonal to or approximately orthogonal to the rotation axis 12. However, the discharge port 11 does not necessarily have to be made orthogonal to the rotation axis 12, and may be formed in the direction parallel to or a direction approximately parallel to the rotation axis 12.

The rotor 3 is provided rotatably around the center axis line of the inner peripheral surface of the container body 2, which has a truncated cone shape, as a rotation axis 12, and rotates counterclockwise when the container body 2 is viewed from an upstream portion toward a downstream portion as shown in FIG. 1.

The rotor 3 has an outer peripheral surface that expands in accordance with the enlargement of the inner diameter of the truncated cone of the container body 2, and the outer peripheral surface of the rotor 3 and the inner peripheral surface of the truncated cone of the container body 2 are maintained at a constant interval.

On the outer peripheral surface of the rotor 3, a first concave-convex portion 13 of the rotor in which concaves and convexes are alternately provided along a surface of the rotor 3 is provided.

The first concave-convex portion 13 of the rotor is inclined with respect to the rotation axis 12 of the rotor 3 in a direction of from the introduction portion 4 to the discharge portion 8, and has a feeding ability in a direction of from the introduction portion 4 to the discharge portion 8. That is, the first concave-convex portion 13 of the rotor is inclined in such a direction that a solution is pushed toward the downstream side when the rotor 3 rotates in the direction shown in FIG. 1.

The level difference between a concave portion 13A and a convex portion 13B of the first concave-convex portion 13 of the rotor is preferably 0.3 to 30, more preferably 0.5 to 15, and further preferably 2 to 7, when a diameter at the concave portion 13A of the outer peripheral surface of the rotor 3 is 100.

The number of convex portions 13B of the first concave-convex portion 13 of the rotor in the circumferential direction is preferably 2 to 1,000, more preferably 6 to 500, and further preferably 12 to 200.

The ratio of the width of the convex portion 13B to the width of the concave portion 13A [width of the convex portion/width of the concave portion] of the first concave-convex portion 13 of the rotor in a cross section orthogonal to the rotation axis 12 of the rotor 3 is preferably 0.01 to 100, more preferably 0.1 to 10, and further preferably 0.5 to 2.

The inclination angle of the first concave-convex portion 13 of the rotor with respect to the rotation axis 12 is preferably 2 to 85°, more preferably 3 to 45°, and further preferably 5 to 20°.

It is preferred that the first inner peripheral surface 6 of the container body 2 is provided with the first concave-convex portion 9 having a plurality of concaves and convexes formed along the inner peripheral surface thereof.

In addition, it is preferred that the concaves and convexes of the first concave-convex portion 9 on the side of the container body 2 are inclined in an opposite direction to the first concave-convex portion 13 of the rotor.

That is, it is preferred that the plurality of concaves and convexes of the first concave-convex portion 9 on the side of the container body 2 are inclined in such a direction that a solution is pushed toward the downstream side when the rotation axis 12 of the rotor 3 rotates in the direction shown in FIG. 1. The stirring ability and the discharge ability are further enhanced by the first concave-convex portion 9 having the plurality of concaves and convexes provided on the first inner peripheral surface 6 of the container body 2.

The depth of the concaves and convexes of the first concave-convex portion 9 on the side of the container body 2 is preferably 0.2 to 30, more preferably 0.5 to 15, and further preferably 1 to 5, when the inner diameter (the diameter) of the container is set to 100.

The number of concaves and convexes of the first concave-convex portion 9 on the side of the container body 2 is preferably 2 to 1,000, more preferably 6 to 500, and further preferably 12 to 200.

The ratio of the width of the concave portion to the width of the convex portion between grooves [width of the concave portion/width of the convex portion] in the concaves and convexes of the first concave-convex portion 9 on the side of the container body 2 is preferably 0.01 to 100, more preferably 0.1 to 10, and further preferably 0.5 to 2 or less.

The inclination angle of the concaves and convexes of the first concave-convex portion 9 on the side of the container body 2 with respect to the rotation axis 12 is preferably 2 to 85°, more preferably 3 to 45°, and further preferably 5 to 20°.

By providing the first concave-convex portion 9 on the first inner peripheral surface 6 of the container body 2, the first inner peripheral surface 6 can be made to function as a shearing portion for imparting a high shearing force to the grease raw material or grease, but the first concave-convex portion 9 does not necessarily have to be provided.

It is preferred that a second concave-convex portion 14 of a rotor having concaves and convexes alternately provided along the surface of the rotor 3 is provided on an outer peripheral surface of a downstream portion of the first concave-convex portion 13 of the rotor.

The second concave-convex portion 14 of the rotor is inclined with respect to the rotation axis 12 of the rotor 3, and has a feeding suppression ability to push a solution back toward the upstream side from the introduction portion 4 toward the discharge portion 8.

The level difference of the second concave-convex portion 14 of the rotor is preferably 0.3 to 30, more preferably 0.5 to 15, and further preferably 2 to 7, when the diameter at the concave portion of the outer peripheral surface of the rotor 3 is set to 100.

The number of convex portions of the second concave-convex portion 14 of the rotor in the circumferential direction is preferably 2 to 1,000, more preferably 6 to 500, and further preferably 12 to 200.

The ratio of the width of the convex portion to the width of the concave portion [width of the convex portion/width of the concave portion] of the second concave-convex portion 14 of the rotor in the cross section orthogonal to the rotation axis of the rotor 3 is preferably 0.01 to 100, more preferably 0.1 to 10, and further preferably 0.5 to 2.

The inclination angle of the second concave-convex portion 14 of the rotor with respect to the rotation axis 12 is preferably 2 to 85°, more preferably 3 to 45°, and further preferably 5 to 20°.

It is preferred that the second inner peripheral surface 7 of the container body 2 is provided with the second concave-convex portion 10 having a plurality of concaves and convexes formed thereon adjacent to a downstream portion of the concaves and convexes in the first concave-convex portion 9 on the side of the container body 2.

It is preferred that the plurality of concaves and convexes are formed on the inner peripheral surface of the container body 2, and that the concaves and convexes are inclined in an opposite direction to the inclination direction of the second concave-convex portion 14 of the rotor.

That is, it is preferred that the plurality of concaves and convexes of the second concave-convex portion 10 on the side of the container body 2 are inclined in such a direction that a solution is pushed back toward the upstream side when the rotation axis 12 of the rotor 3 rotates in the direction shown in FIG. 1. A stirring ability is more enhanced by the concaves and convexes of the second concave-convex portion 10 provided on the second inner peripheral surface 7 of the container body 2. In addition, the second inner peripheral surface 7 of the container body can function as a shearing portion which imparts a high shearing force to the grease raw material or grease.

The depth of the concave portion of the second concave-convex portion 10 on the side of the container body 2 is preferably 0.2 to 30, more preferably 0.5 to 15, and further preferably 1 to 5, when the inner diameter (the diameter) of the container body 2 is set to 100.

The number of concave portions of the second concave-convex portion 10 on the side of the container body 2 is preferably 2 to 1,000, more preferably 6 to 500, and further preferably 12 to 200.

The ratio of the width of the convex portion to the width of the concave portion [width of the convex portion/width of the concave portion] in the concaves and convexes of the second concave-convex portion 10 on the side of the container body 2 in the cross section orthogonal to the rotation axis 12 of the rotor 3 is preferably 0.01 to 100, more preferably 0.1 to 10, and further preferably 0.5 to 2 or less.

The inclination angle of the second concave-convex portion 10 on the side of the container body 2 with respect to the rotation axis 12 is preferably 2 to 85°, more preferably 3 to 45°, and further preferably 5 to 20°.

The ratio of the length of the first concave-convex portion 9 on the side of the container body 2 to the length of the second concave-convex portion 10 on the side of the container body 2 [(length of the first concave-convex portion)/(length of the second concave-convex portion)] is preferably 2/1 to 20/1.

Figure 2:
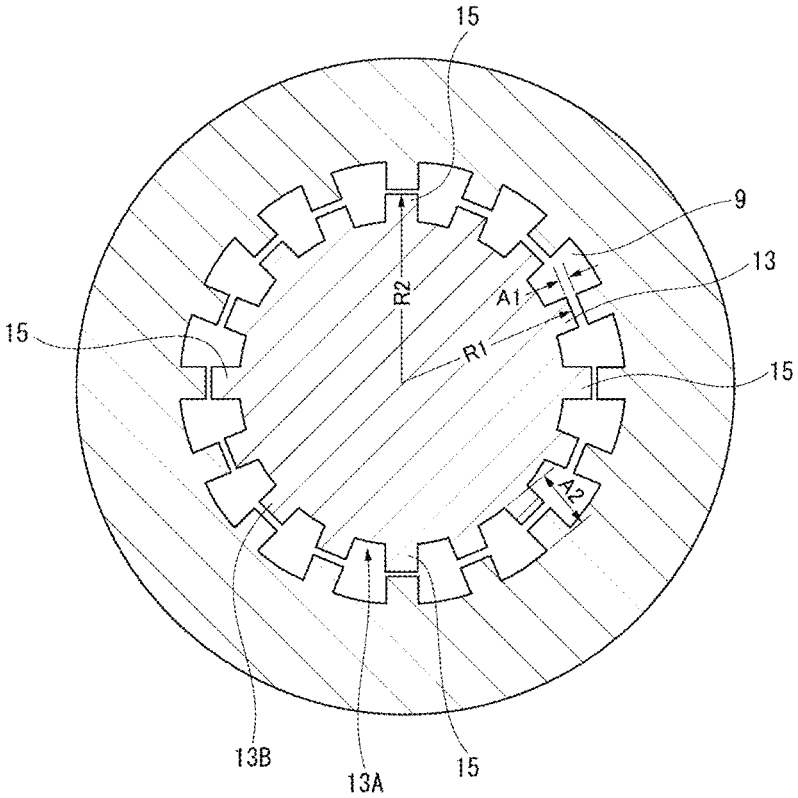
FIG. 2 is a schematic cross-sectional view in the direction orthogonal to a rotation axis in a first concave-convex portion on the side of a container body of the grease manufacturing apparatus of FIG. 1.

FIG. 2 is a cross-sectional view in the direction orthogonal to the rotation axis 12 in the first concave-convex portion 9 on the side of the container body 2 of the grease manufacturing apparatus 1.

In the first concave-convex portion 13 of the rotor shown in FIG. 2, a plurality of scrapers 15 each having a tip protruding toward the inner peripheral surface side of the container body 2 beyond a tip in the projecting direction of the convex portion 13B of the first concave-convex portion 13 are provided. In addition, though not shown, the second concave-convex portion 14 is also provided with a plurality of scrapers in which a tip of the convex portion protrudes toward the inner peripheral surface side of the container body 2, similarly to the first concave-convex portion 13.

The scraper 15 scrapes off the grease adhering to the inner peripheral surface of the first concave-convex portion 9 on the side of the container body 2 and the second concave-convex portion 10 on the side of the container body 2.

With respect to the protrusion amount of the tip of the scraper 15 relative to the protrusion amount of the convex portion 13B of the first concave-convex portion 13 of the rotor, the ratio [R2/R1] of the radius (R2) at the tip of the scraper 15 to the radius (R1) at the tip of the convex portion 13B is preferably more than 1.005 and less than 2.0.

The number of scrapers 15 is preferably 2 to 500, more preferably 2 to 50, and further preferably 2 to 10.

In the grease manufacturing apparatus 1 shown in FIG. 2, the scrapers 15 are provided, but the scraper 15 may not be provided, or the scraper 15 may be provided intermittently.

In order to produce a grease containing the urea-based thickener (B) by the grease manufacturing apparatus 1, the solution a and the solution β which are the aforementioned grease raw materials are introduced respectively from the solution introducing pipes 4A and 4B of the introduction portion 4 of the container body 2, and the rotor 3 is rotated at a high speed, whereby a grease base material containing the urea-based thickener (B) can be produced.

Then, even when the sulfur-phosphorus-based extreme pressure agent (C) and another additive (D) are blended with the thus obtained grease base material, the urea-based thickener (B) in the grease composition can be miniaturized so as to satisfy the requirement (I) and further the requirement (II).

As a high-speed rotation condition of the rotor 3, a shear rate to be applied to the grease raw material is preferably $10^2$ $s^{-1}$ or more, more preferably $10^3$ $s^{-1}$ or more, and further preferably $10^4$ $s^{-1}$ or more, and the shear rate is typically $10^7$ $s^{-1}$ or less.

The ratio of a maximum shear rate (Max) to a minimum shear rate (Min) (Max/Min) in shearing at the time of high-speed rotation of the rotor 3 is preferably 100 or less, more preferably 50 or less, and further preferably 10 or less.

When the shear rate for a mixed solution is as uniform as possible, the urea-based thickener (B) or a precursor thereof in the grease composition is readily miniaturized, whereby a more uniform grease structure is provided.

Here, the maximum shear rate (Max) is the highest shear rate applied to the mixed solution, and the minimum shear rate (Min) is the lowest shear rate applied to the mixed solution, which are defined as follows.

Maximum shear rate (Max)=(linear velocity at the tip of the convex portion 13*B* of the first concave-convex portion 13 of the rotor)/(gap *A*1 between the tip of the convex portion 13*B* of the first concave-convex portion 13 of the rotor and the convex portion of the first concave-convex portion 9 of the first inner peripheral surface 6 of the container body 2)

Minimum shear rate (Min)=(linear velocity of the concave portion 13*A* of the first concave-convex portion 13 of the rotor)/(gap *A*2 between the concave portion 13*A* of the first concave-convex portion 13 of the rotor and the concave portion of the first concave-convex portion 9 on the first inner peripheral surface 6 of the container body 2)

The gap A1 and the gap A2 are as shown in FIG. 2.

The grease manufacturing apparatus 1 is provided with the scraper 15, thereby grease adhering to the inner peripheral surface of the container body 2 can be scraped off, so that the generation of the lumps during kneading can be prevented, and a grease in which the urea-based thickener (B) is miniaturized can be continuously produced in a short time.

As a result of scrapering off the adhering grease by the scraper 15, it is possible to prevent the retained grease from becoming a resistance to rotation of the rotor 3, so that the rotational torque of the rotor 3 can be reduced, and the power consumption of the drive source can be reduced, thereby making it possible to continuously produce a grease efficiently.

Since the inner peripheral surface of the container body 2 is in a shape of a truncated cone whose inner diameter increases from the introduction portion 4 toward the discharge portion 8, the centrifugal force has an effect for discharging a grease or grease raw material in the downstream direction, and the rotation torque of the rotor 3 can be reduced to continuously produce a grease.

The first concave-convex portion 13 of the rotor is provided on the outer peripheral surface of the rotor 3, the first concave-convex portion 13 of the rotor is inclined with respect to the rotation axis 12 of the rotor 3, the first concave-convex portion 13 has a feeding ability from the introduction portion 4 to the discharge portion 8, the second concave-convex portion 14 of the rotor is inclined with respect to the rotation axis 12 of the rotor 3, and the second concave-convex portion 14 has a feeding suppression ability from the introduction portion 4 to the discharge portion 8. Accordingly, a high shear force can be given to the solution, and the urea-based thickener (B) in the grease composition can be miniaturized so as to satisfy the requirement (I) and further the requirement (II) even after blending the additive.

The first concave-convex portion 9 is formed on the first inner peripheral surface 6 of the container body 2 and is inclined in an opposite direction to the first concave-convex portion 13 of the rotor. Accordingly, in addition to the effect of the first concave-convex portion 13 of the rotor, sufficient stirring of the grease raw material can be carried out while extruding the grease or grease raw material in the downstream direction, and the urea-based thickener (B) in the grease composition can be miniaturized so as to satisfy the requirement (I) and further the requirement (II) even after blending the additive.

The second concave-convex portion 10 is provided on the second inner peripheral surface 7 of the container body 2, and the second concave-convex portion 14 of the rotor is provided on the outer peripheral surface of the rotor 3. Accordingly, the grease raw material can be prevented from flowing out from the first inner peripheral surface 6 of the container body more than necessary, so that a high shear force is given to the solution to highly disperse the grease raw material, whereby the urea-based thickener (B) can be miniaturized so as to satisfy the requirement (I) and further the requirement (II) even after blending the additive.

<Polymer Compound (C)>

The grease composition of the present invention contains the polymer compound (C), together with the component (A) and the component (B). In addition, the number average molecular weight (Mn) of the polymer compound (C) is 30,000 or more and the molecular weight distribution (Mw/Mn) of the polymer compound (C) is 2.20 or less.

When the grease composition of the present invention contains the polymer compound (C) and the number average molecular weight (Mn) and the molecular weight distribution (Mw/Mn) of the polymer compound (C) satisfy the above ranges, the friction coefficient in the grease composition can be reduced.

When the molecular weight distribution (Mw/Mn) of the polymer compound (C) is more than 2.20, or the number average molecular weight (Mn) of the polymer compound (C) is less than 30,000, a sufficient friction reducing effect cannot be achieved.

From the viewpoint of frictional characteristics, the mass average molecular weight (Mw) of the polymer compound (C) is preferably 50,000 or more, more preferably 100,000 or more. From the viewpoint of availability of the polymer compound (C), the mass average molecular weight (Mw) of the polymer compound (C) is preferably 1,000,000 or less.

The upper limits and the lower limits of the numerical ranges can be arbitrarily combined. Specifically, the mass average molecular weight (Mw) is preferably 50,000 to 1,000,000, more preferably 100,000 to 1,000,000.

From the viewpoint of frictional characteristics, the number average molecular weight (Mn) of the polymer compound (C) is 30,000 or more, preferably 50,000 or more, more preferably 80,000 or more. From the viewpoint of availability of the polymer compound (C), the number average molecular weight (Mn) of the polymer compound (C) is preferably 500,000 or less.

The upper limits and the lower limits of the numerical ranges can be arbitrarily combined. Specifically, the number average molecular weight (Mn) is preferably 30,000 to 500,000, more preferably 50,000 to 500,000, further preferably 80,000 to 500,000.

From the viewpoint of frictional characteristics, the molecular weight distribution (Mw/Mn) of the polymer compound (C) is 2.20 or less, preferably 2.00 or less, more preferably 1.90 or less, further preferably 1.85 or less. From the viewpoint of availability of the polymer compound (C), the molecular weight distribution (Mw/Mn) of the polymer compound (C) is preferably 1.10 or more.

The upper limits and the lower limits of the numerical ranges can be arbitrarily combined. Specifically, the molecular weight distribution (Mw/Mn) is preferably 1.10 to 2.20, more preferably 1.10 to 2.00, further preferably 1.10 to 1.90, still further preferably 1.10 to 1.85.

The polymer compound (C) is not particularly limited as long as it satisfies the conditions that the number average molecular weight (Mn) is 30,000 or more and the molecular weight distribution (Mw/Mn) is 2.20 or less, and a generally used polymer compound can be applied.

Examples of the polymer compound (C) include polymers, such as a non-dispersant-type poly(meth)acrylate, a dispersant-type poly(meth)acrylate, a star polymer, an olefinic copolymer, a dispersant-type olefinic copolymer, a polyalkylstyrene, and a styrene-based copolymer.

Examples of the olefinic copolymer include an ethylene-propylene copolymer and an ethylene-butylene copolymer.

Examples of the styrene-based copolymer include a styrene-diene copolymer and a styrene-isoprene copolymer.

One of these polymers can be used alone or two or more thereof may be used in combination. The polymers may be a random copolymer or a block copolymer.

Among them, an ethylene-propylene copolymer and an ethylene-butylene copolymer are preferred.

When the polymer compound (C) is a polymer containing ethylene, such as an ethylene-propylene copolymer or an ethylene-butylene copolymer, the ethylene content based on the total amount of the polymers containing ethylene is preferably 30% by mass to 70% by mass, more preferably 40% by mass to 60% by mass.

The ethylene content in the polymer containing ethylene can be measured by a method described in Examples as mentioned later.

The content of the polymer compound (C) in terms of resin is, from the viewpoint of reducing the friction coefficient, preferably 0.1 to 10.0% by mass, more preferably 0.1 to 5.0% by mass, further preferably 0.1 to 3.7% by mass, still further preferably 0.5 to 2.5% by mass, furthermore preferably 1.0 to 2.3% by mass based on the total amount (100% by mass) of the grease composition.

The ratio [(B)/(C)] of the urea-based thickener (B) to the polymer compound (C) contained is, from the viewpoint of frictional characteristics, at a mass ratio, preferably 0.5 to 5.0 by mass, more preferably 1.0 to 4.5, further preferably 2.0 to 4.0, still further preferably 2.5 to 3.8, furthermore preferably 2.8 to 3.4.

<Additive (D)>

The grease composition of an embodiment of the present invention may contain an additive (D) that is blended in a conventional grease and that is other than the component (B) and the component (C) to the extent that the effect of the present invention is not impaired.

Examples of the additive (D) include an antioxidant, a rust inhibitor, an extreme pressure agent, a solid lubricant, a detergent dispersant, a corrosion inhibitor, and a metal deactivator.

As the additive (D), one of additives may be used alone or two or more thereof may be used in combination.

Examples of the antioxidant include phenol-based antioxidants.

Examples of the rust inhibitor include a carboxylic acid-based rust inhibitor, such as an alkenyl succinic acid polyhydric alcohol ester, zinc stearate, thiadiazole and a derivative thereof, and benzotriazole and a derivative thereof.

Examples of the extreme pressure agent include zinc dialkyldithiophosphate, molybdenum dialkyldithiophosphate, thiocarbamic acid compounds, such as ashless dithiocarbamate, zinc dithiocarbamate, and molybdenum dithiocarbamate; sulfur compounds, such as sulfurized fats and oils, sulfurized olefins, polysulfides, thiophosphoric acids, thioterpenes, and dialkylthiodipropionates; a phosphate ester, such as tricresyl phosphate; and a phosphite ester, such as triphenyl phosphite.

Examples of the solid lubricant include polyimide, PTFE, graphite, metal oxide, boron nitride, melamine cyanurate (MCA), and molybdenum disulfide.

Examples of the detergent dispersant include ashless dispersants, such as succinimide and boron succinimide.

Examples of the corrosion inhibitor include benzotriazole compounds and thiazole compounds.

Examples of the metal deactivator include benzotriazole compounds.

In the grease composition of an embodiment of the present invention, the contents of the additives (D) are appropriately set depending on the type of the additive, and are each independently typically 0.01 to 20% by mass, preferably 0.01 to 15% by mass, more preferably 0.01 to 10% by mass, and further preferably 0.01 to 7% by mass based on the total amount (100% by mass) of the grease composition.

<Physical Properties of Grease Composition>

(Worked Penetration)

The worked penetration at 25° C. of the grease composition of an embodiment of the present invention is, from the viewpoint of superior frictional characteristics, preferably 220 to 430, more preferably 240 to 360, further preferably 250 to 350, still further preferably 260 to 330.

In this description, the worked penetration of the grease composition means a value measured at 25° C. according to JIS K2220: 2013 (Item 7).

(Friction Coefficient Reducing Effect)

For the grease composition of an embodiment of the present invention, the friction coefficient reducing effect can be evaluated by determining a rate of reduction of friction coefficient by a method described in Examples as mentioned later.

The rate of reduction of friction coefficient obtained by the method described in Examples as mentioned later is preferably 45% or more.

<Method of Producing Grease Composition>

The grease composition of the present invention can be produced by mixing the base oil (A), a grease (base grease) containing the urea-based thickener (B), and the polymer compound (C), and the additive (D) as required.

For example, the grease composition can be produced by mixing the base oil (A) and the additive (D), then mixing a grease (base grease) containing the urea-based thickener (B), and then, further adding and mixing the polymer compound (C).

<Application of Grease Composition>

The grease composition of the present invention is superior in reduction of friction coefficient. In particular, when used for lubrication of a sliding portion composed of a metal material and a resin material, the grease composition is superior in reduction of friction coefficient under conditions of low speed and low load.

Thus, the grease composition of an embodiment of the present invention can be suitably used in application for lubricating a sliding portion of various devices, and is particularly preferably used in application for lubricating a device having a sliding portion composed of a metal material and a resin material.

As the metal material, various steels, such as carbon steel and stainless steel, various alloys, such as an aluminum alloy, and cupper are preferred. The metal material may be replaced by a material having a high strength (for example, a ceramic material).

The resin material may be a natural resin or a synthetic resin. A general-purpose plastic of a synthetic resin (polyethylene, polystyrene, polypropylene, polyvinyl chloride, etc.) and an engineering plastic are preferred, and from the viewpoint of heat resistance and mechanical strength, an engineering plastic is more preferred.

Examples of the engineering plastic include synthetic resins, such as a polyamide resin, a polyacetal resin, a polycarbonate resin, a polysulfone resin, a polyphenylenesulfide resin, a polyamideimide resin, a polyether ether ketone resin, a phenol resin, a polyester resin, and an epoxy resin.

As a resin material, a fiber-reinforced resin material is preferred.

An example of the fiber-reinforced resin material is a glass fiber-reinforced resin material.

Examples of the field of device for which the grease composition of the present invention can be suitably used include the automotive field, the office equipment field, the machine-tool field, the windmill field, the field for construction, the field for agricultural machine, and the industrial robot field.

Examples of the portion to be lubricated in a device for the automotive field, in which the grease composition of the present invention can be suitably used, include bearing portions in devices, such as a radiator fan motor, a fan coupling, an alternator, an idler pulley, a hub unit, a water pump, a power window, a wiper, an electric power steering, a driving electric motor fly wheel, a ball joint, a wheel bearing, a spline portion, and a constant velocity joint; and bearing portions, gear portions, and sliding portions in devices, such as a door lock, a door hinge, and a clutch booster.

More specific examples include bearing parts of a hub unit, an electric power steering, an electric driving motor fly wheel, a ball joint, a wheel bearing, a spline part, a constant-velocity joint, a clutch booster, a servomotor, a blade bearing, or a generator.

Examples of the portion to be lubricated in a device for the office equipment field, in which the grease composition of the present invention can be suitably used, include a fixing roll in a device, such as a printer, and bearing and gear portions in a device, such as a polygon motor.

Examples of the portion to be lubricated in a device for the machine-tool field, in which the grease composition of the present invention can be suitably used, include bearing portions in a reduction gear of a spindle, a servo motor, a working robot, or the like.

Examples of the portion to be lubricated in a device for the windmill field, in which the grease composition of the present invention can be suitably used, include a blade bearing and bearing portions of a generator.

Examples of the portion to be lubricated in a device for the field for construction or for agricultural machine, in which the grease composition of the present invention can be suitably used, include bearing portions, gear portions, and sliding portions of a ball joint, a spline part, and the like.

An aspect of a device in which the grease composition of the present invention can be applied is preferably a speed reducer (worm gear) of electric power steering in which the sliding mechanism has a metal worm and a resin worm wheel. When the device has such a configuration, since reduction of friction coefficient under conditions of low speed and low load is excellent, the frictional characteristics is excellent even in running at a high speed under such control that an assist by EPS does not act.

[Method of Lubricating Sliding Mechanism]

A method of lubricating a sliding mechanism, the method being applicable to the grease composition of the present invention, is a method including lubricating a sliding mechanism in which a metal material and a resin material slide on each other with the aforementioned grease composition of the present invention.

According to the method of lubricating a sliding mechanism, the method being applicable to the grease composition of the present invention, the dynamic friction in the lubricated portion can be suitably maintained. This effect can be achieved for the following reason. When the sliding mechanism is a speed reducer (worm gear) of electric power steering having a metal worm and a resin worm wheel, since reduction of friction coefficient under conditions of low speed and low load is excellent, the frictional characteristics can be excellent even in running at a high speed under such control that an assist by EPS does not act.

According to an embodiment of the present invention, the following [1] to [11] are provided.

[1] A grease composition, containing:

a base oil (A);

a urea-based thickener (B); and a polymer compound (C), wherein particles that contain the urea-based thickener (B) in the grease composition satisfying the following requirement (I):

requirement (I): the particles have an arithmetic average particle diameter on an area basis as measured by a laser diffraction/scattering method of 2.0 μm or less, and the polymer compound (C) having a number average molecular weight (Mn) of 30,000 or more and a molecular weight distribution (Mw/Mn) of 2.20 or less.

[2] The grease composition according to the above [1], in which the particles that contain the urea-based thickener (B) in the grease composition further satisfies the following requirement (II):

requirement (II): the particles have a specific surface area as measured by a laser diffraction/scattering method of $0.5\times10^5$ $cm^2/cm^3$ or more.

[3] The grease composition according to the above [1] or [2], in which the polymer compound (C) is contained in an amount in terms of resin of 0.1% by mass to 10.0% by mass based on the total amount of the grease composition.

[4] The grease composition according to any one of the above [1] to [3], in which the polymer compound (C) contains an ethylene-propylene copolymer.

[5] The grease composition according to the above [4], in which the ethylene-propylene copolymer has an ethylene content of 40% by mass to 60% by mass based on the total amount of the ethylene-propylene copolymer.

[6] The grease composition according to any one of the above [1] to [5], in which the base oil (A) has a 40° C. kinematic viscosity of 10 $mm^2/s$ to 150 $mm^2/s$.

[7] The grease composition according to any one of the above [1] to [6], in which a content [(B)/(C)] of the urea-based thickener (B) to the polymer compound (C) is at a mass ratio, 1.0 to 4.5.

[8] The grease composition according to any one of the above [1] to [7], in which the urea-based thickener (B) is contained in an amount of 1.0% by mass to 15.0% by mass based on the total amount of the grease composition.

[9] The grease composition according to any one of the above [1] to [8], in which the grease composition has a worked penetration of 250 to 350.

[10] The grease composition according to any one of the above [1] to [9], in which the grease composition is to be used for lubrication of a sliding mechanism in which a metal material and a resin material slide on each other.

[11] A lubrication method, the method including lubricating a sliding mechanism in which a metal material and a resin material slide on each other with the grease composition according to any one of the above [1] to [10].

EXAMPLES

The present invention will be described more specifically with reference to the following examples, but the present invention is not to be limited to the following examples.

[Various Physical Property Values]

The measurement methods of various physical property values were as follows.

(1) 40° C. Kinematic Viscosity and Viscosity Index of Base Oil (A)

The 40° C. kinematic viscosity and viscosity index were measured and calculated according to JIS K2283:2000.

(2) Mass Average Molecular Weight (Mw), Number Average Molecular Weight (Mn), and Molecular Weight Distribution (Mw/Mn) of Polymer Compound (C)

Values measured in terms of polystyrene standards using a gel permeation chromatography apparatus (apparatus name "1260-type HPLC" manufactured by Agilent Technologies Japan, Ltd.) according to the following measurement conditions.

Measurement Conditions

Column: 2×"Shodex LF404" connected in series

Column temperature: 35° C.

Eluent: chloroform

Flow rate: 0.3 mL/min (3) Ethylene Content in Polymer Compound (C)

The ethylene content was calculated by analysis of a 13C-NMR quantitative spectrum (4) Worked Penetration of Grease Composition The worked penetration was measured at 25° C. according to JIS K2220:2013 (Item 7).

[Raw Materials]

The base oils (A) and the polymer compounds (C) used as raw materials for preparing a grease composition in Examples 1 to 6 and Comparative Examples 1 to 4 were as follows.

The contents shown in Tables 1 to 2 are contents in terms of resin.

<Base Oil (A)>

Base oil (A1): (poly-α-olefin (PAO), 40° C. kinematic viscosity: 30 $mm^2/s$, viscosity index: 135)

Base oil (A2): (poly-α-olefin (PAO), 40° C. kinematic viscosity: 63 $mm^2/s$, viscosity index: 140)

<Polymer Compound (C)>

Polymer Compound (C1)

Ethylene-propylene copolymer, mass average molecular weight (Mw): 172,000, number average molecular weight (Mn): 93,500, molecular weight distribution (Mw/Mn): 1.84, ethylene content: 58.6% by mass Polymer Compound (C2)

Ethylene-propylene copolymer, mass average molecular weight (Mw): 270,000, number average molecular weight (Mn): 149,000, molecular weight distribution (Mw/Mn): 1.81, ethylene content: 52.5% by mass Polymer Compound (C3)

Ethylene-propylene copolymer, mass average molecular weight (Mw): 284,000, number average molecular weight (Mn): 166,000, molecular weight distribution (Mw/Mn): 1.71, ethylene content: 51.6% by mass Polymer Compound (C4)

Ethylene-butylene copolymer, mass average molecular weight (Mw): 258,000, number average molecular weight (Mn): 148,000, molecular weight distribution (Mw/Mn): 1.74, ethylene content: 67.3% by mass Polymer compound (C')

Ethylene-propylene copolymer, mass average molecular weight (Mw): 109,000, number average molecular weight (Mn): 47,800, molecular weight distribution (Mw/Mn): 2.28, ethylene content: 53.2% by mass

Example 1

(1) Synthesis of Urea Grease

To 89.26 parts by mass of the base oil (A1) heated to 70° C., 10.74 parts by mass of diphenylmethane-4,4'-diisocyanate (MDI) was added to prepare a solution α.

To 82.72 parts by mass of the base oil (A1) heated to 70° C. which was separately provided, 3.40 parts by mass of cyclohexylamine and 13.88 parts by mass of octadecylamine (stearylamine) were added to prepare a solution β.

Then, using the grease manufacturing apparatus 1 shown in FIG. 1, the solution a heated to 70° C. and the solution β heated to 70° C. were introduced into the container body 2 through the solution introducing pipe 4A and through the solution introducing pipe 4B, respectively, in an equal amount at the same time. The solution a and the solution β were continuously introduced into the container body 2 while the rotor 3 was rotated. After that, the mixture was heated to 160° C. with a stirring apparatus shown in FIG. 3, and after stirring for 1 hour, the mixture was treated with a roll mill into a uniform state, whereby a urea grease (b1) was synthesized.

The rotational speed of the rotor 3 of the grease manufacturing apparatus 1 used was 8,000 rpm. In this case, stirring was carried out at a maximum shear rate (Max) of 10,500 $s^{-1}$ and a ratio between the maximum shear rate (Max) and the minimum shear rate (Min) [Max/Min] of 3.5.

The urea-based thickener (B1) contained in the resulting urea grease corresponds to a compound of the general formula (b1) in which $R^1$ and $R^2$ are a cyclohexyl group or an octadecyl group (stearyl group) and $R^3$ is a diphenyl methylene group.

The molar ratio (cyclohexylamine/octadecylamine) of cyclohexylamine to octadecylamine used as raw materials is 40/60.

(2) Preparation of Grease Composition

The polymer compound (C1) was added to the urea grease obtained in the above (1) with stirring at 120° C. Then, after stirring for 0.5 hours, the mixture was allowed to naturally cool to 25° C. to obtain a grease composition of Example 1.

The contents of the components in the grease composition of Example 1 are as shown in Table 1.

Example 2

A grease composition of Example 2 was obtained in the same manner as in Example 1 except for changing the contents of the components in (1) Synthesis of Urea Grease of Example 1 to the following values.

Base oil (A1) heated to 70° C.: 87.29 parts by mass

Diphenylmethane-4,4'-diisocyanate (MDI): 12.71 parts by mass

Separately provided base oil (A1) heated to 70° C.: 86.51 parts by mass

Cyclohexylamine: 8.03 parts by mass

Octadecylamine (stearylamine): 5.46 parts by mass

A urea-based thickener (B2) contained in the resulting urea grease corresponds to a compound of the general formula (b1) in which $R^1$ and $R^2$ are a cyclohexyl group or an octadecyl group (stearyl group) and $R^3$ is a diphenylmethylene group.

The molar ratio (cyclohexylamine/octadecylamine) of cyclohexylamine to octadecylamine used as raw materials is 80/20.

Example 4

A grease composition of Example 4 was obtained in the same manner as in Example 1 except for using octylamine in place of cyclohexylamine in (1) Synthesis of Urea Grease of Example 1 and changing the contents of the components to the following values.

Base oil (A1) heated to 70° C.: 89.91 parts by mass

Diphenylmethane-4,4'-diisocyanate (MDI): 10.09 parts by mass

Separately provided base oil (A1) heated to 70° C.: 83.87 parts by mass

Octylamine: 5.24 parts by mass

Octadecylamine (stearylamine): 10.90 parts by mass

A urea-based thickener (B3) contained in the resulting urea grease corresponds to a compound of the general formula (b1) in which $R^1$ and $R^2$ are an octyl group or an octadecyl group (stearyl group) and $R^3$ is a diphenylmethylene group.

The molar ratio (octylamine/octadecylamine) of octylamine to octadecylamine used as raw materials is 50/50.

Comparative Example 3

To 89.26 parts by mass of the base oil (A1) heated to 70° C., 10.74 parts by mass of diphenylmethane-4,4'-diisocyanate (MDI) was added to prepare the solution a.

To 82.72 parts by mass of the base oil (A1) heated to 70° C. which was separately provided, 3.40 parts by mass of cyclohexylamine and 13.88 parts by mass of octadecylamine (stearylamine) were added to prepare the solution β.

Figure 3:
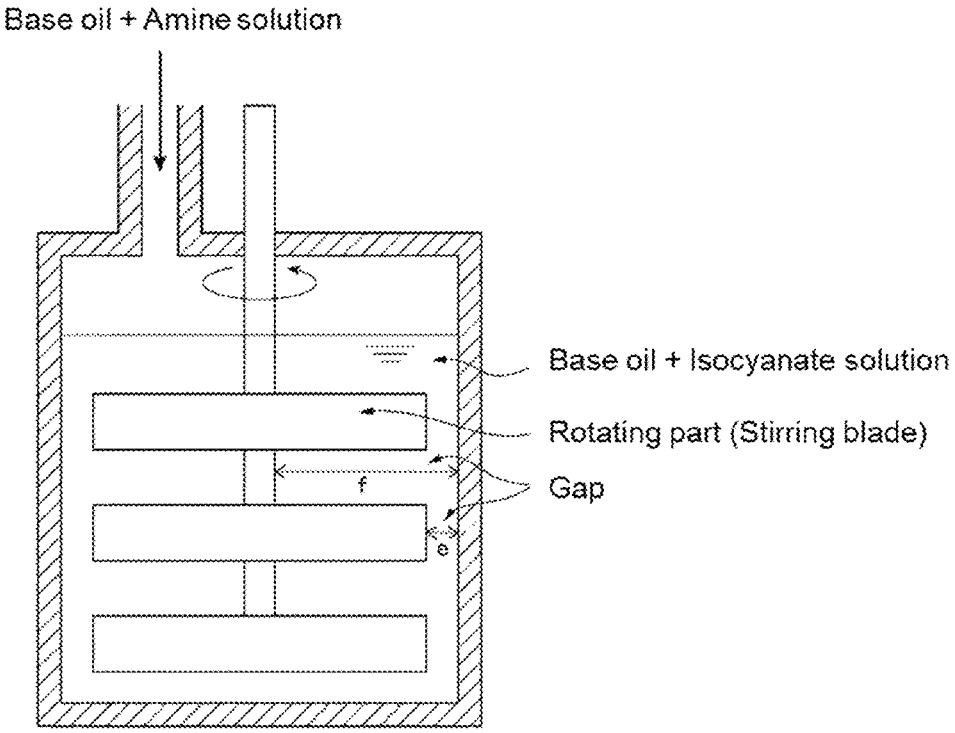
FIG. 3 is a schematic cross-sectional view of a grease manufacturing apparatus used in the Comparative Example 3.

Then, using a grease production apparatus 1 shown in FIG. 3, the solution a heated to 70° C. was introduced through a solution introducing tube into a content body. Then, with stirring, the solution β heated to 70° C. was introduced through the solution introducing tube into the container body containing the solution a. After introducing the entire solution β into the container body, the stirring blade was rotated, and while continuously stirring, the temperature was increased to 160° C. and was kept for 1 hour to thus synthesize a urea grease (b2), which was taken as a grease composition of Comparative Example 3.

The maximum shear rate (Max) at this time was about 100 s'1 and the minimum shear rate was 1.23 $s^{-1}$. The ratio (Max/Min) of the maximum shear rate (Max) to the minimum shear rate (Min) was about 81.

The urea-based thickener contained in the urea grease (b2) corresponds a compound of the general formula (b1) in which $R^1$ and $R^2$ are a cyclohexyl group or an octadecyl group (stearyl group) and $R^3$ is a diphenylmethylene group.

The molar ratio (cyclohexylamine/octadecylamine) of cyclohexylamine to octadecylamine used as raw materials is 40/60.

Comparative Example 4

A grease composition of Comparative Example 4 was obtained by further adding the polymer compound (C1), followed by mixing, in Comparative Example 3.

Examples 3, 5 to 6, Comparative Examples 1 to 2

Each grease composition was prepared in the same manner as in the aforementioned grease composition except for changing the components and contents to values shown in Tables 1 to 2.

[Requirement]

The urea greases synthesized in Examples 1 to 6 and Comparative Examples 1 to 4 were subjected to the following calculations.

(1) Calculation of Particle Diameter of Particles Containing a Urea-Based Thickener: Requirement (I)

The particle diameter of particles containing a urea-based thickener of each grease composition was evaluated. Specifically, the urea greases synthesized in Examples 1 to 6 and the urea greases synthesized in Comparative Examples 1 to 4 were each taken as a measurement sample, and the particle diameter of particles containing the particle diameter of particles containing the urea-based thickener (B) was determined by the following procedure.

First, the measurement sample was defoamed under vacuum and then was filled in a 1-mL syringe. From the syringe, 0.10 to 0.15 mL of the sample was pushed out, and the pushed-out sample was placed on a surface of a tabular cell of a paste cell fixture. Next, another tabular cell was superposed on the sample to obtain a measurement cell in which the sample was interposed between the two cells. Next, using a laser diffraction-type particle size analyzer (trade name: LA-920, manufactured by Horiba Ltd.), the arithmetic average particle diameter on an area basis of particles in the sample in the measurement cell was measured.

Here, the "arithmetic average particle diameter on an area basis" means a value obtained by arithmetically averaging the particle diameter distribution in an area basis. The particle diameter distribution on an area basis is a value of the frequency distribution of the particle diameters in all the particles to be measured which is indicated on the basis of the area calculated from the particle diameter (specifically, the sectional area of a particle having the particle diameter). The value obtained by arithmetically averaging the particle diameter distribution on an area basis can be calculated by the following formula (1).

$$\text{Arithmetic average particle diameter}=\Sigma\{q(J)\times X(J)\}+\Sigma\{q(J)\} \quad (1)$$

In the formula (1), J means a fraction number of the particle diameters. q(J) means a frequency distribution (unit: %). X(J) is a representative diameter (unit: μm) of the Jth particle diameter range.

(2) Calculation of Specific Surface Area of Particles Containing a Urea-Based Thickener: Requirement (II)

Using the particle diameter distribution, which was measured in the section of requirement (I), of particles containing a thickener in the grease composition, the specific surface area was determined. Specifically, using the particle diameter distribution, the total of the surface areas (unit: $cm^2$) of the particles per unit volume (1 $cm^3$) was calculated, and this was taken as the specific surface area (unit: $cm^2/cm^3$).

Next, based on Examples 1 to 6 and Comparative Examples 1 to 4, reduction of friction coefficient was evaluated.

[Evaluation of Friction Coefficient Reducing Effect]

According to JIS K7218-A, a sliding test was performed under the following test conditions, and the friction coefficient of a sliding portion of a metal material and a resin material was measured. (When a test is performed under conditions of a high speed and a high load by this test method, the test can be performed, for example, at a sliding rate of 1.0 m/s and a load of 350 N, or the like. On the other hand, in Examples, in order to evaluate the frictional characteristics under conditions of a low speed and a low load, a sliding test was performed under the following test conditions.)

The rate of reduction of friction coefficient relative to the friction coefficient of Comparative Example which was taken as a reference value (the rate of reduction of friction coefficient) was calculated to evaluated the friction coefficient reducing effect according to the following evaluation criteria. In the following evaluation criteria, "B" or higher is an acceptable level.

With regard to Examples 1 to 6 and Comparative Examples 2, the value of Comparative Example 1 that did not contain the polymer compound (C) but contained the urea-based thickener (B) was taken as a reference value. With regard to Comparative Example 4, the value of Comparative example 3 that did not contain the polymer compound (C) but contained the thickener (B') was taken as a reference value.

Test Conditions

Test apparatus: thrust sliding tester (apparatus name: EFM-III-F-ADX-S, manufactured by A&D Company, Limited)

Metal test piece: roller shape, diameter: 10 mm, material: S45C

Resin test piece: ring shape, outer diameter: 25.6 mm, inner diameter: 20 mm, material: polyamide 66 with 15% by mass of glass fibers mixed therein Sliding speed: 0.2 m/s Load: 50 N Testing time: 5 minutes Test temperature: room temperature (25° C.)

Evaluation Criteria of Friction Coefficient Reducing Effect

A: a rate of reduction of friction coefficient relative to the reference friction coefficient (rate of reduction of friction coefficient) of 50% or more B: a rate of reduction of friction coefficient relative to the reference friction coefficient (rate of reduction of friction coefficient) of 45% or more and less than 50%

C: a rate of reduction of friction coefficient relative to the reference friction coefficient (rate of reduction of friction coefficient) less than 45%

The evaluation results are shown in Tables 1 to 2.

TABLE 1

| Component (unit) | | | | Example 1 | 2 | 3 | 4 | 5 | 6 |
|---|---|---|---|---|---|---|---|---|---|
| Grease composition | Base oil (A) | Base oil (A1) | % by mass | 91.5 | 92.8 | 91.5 | 91.5 | — | — |
| | | Base oil (A2) | % by mass | — | — | — | — | 91.0 | 91.0 |
| | Thickener (B) | Urea-based thickener (B1) | % by mass | 6.5 | — | — | — | 7.0 | 7.0 |
| | | Urea-based thickener (B2) | % by mass | — | 5.2 | 6.5 | — | — | — |
| | | Urea-based thickener (B3) | % by mass | — | — | — | 6.5 | — | — |
| | | Thickener (B') | % by mass | — | — | — | — | — | — |
| | Polymer compound (C) | Polymer compound (C1) | % by mass | 2.0 | — | — | — | — | — |
| | | Polymer compound (C2) | % by mass | — | 2.0 | 2.0 | 2.0 | — | — |
| | | Polymer compound (C3) | % by mass | — | — | — | — | 2.0 | — |
| | | Polymer compound (C4) | % by mass | — | — | — | — | — | 2.0 |
| | | Polymer compound (C') | % by mass | — | — | — | — | — | — |
| Total | | | % by mass | 100.0 | 100.0 | 100.0 | 100.0 | 100.0 | 100.0 |
| Content ratio [(B)/(C)] | | | — | 3.3 | 2.6 | 3.3 | 3.3 | 3.5 | 3.5 |
| Physical property value | Base oil (A) | 40° C. Kinematic viscosity | $mm^2/s$ | 30 | 30 | 30 | 30 | 63 | 63 |
| | | Viscosity index | — | 135 | 135 | 135 | 135 | 140 | 140 |
| | Thickener (B) | Arithmetic average particle diameter of particles | μm | 0.3 | 0.4 | 0.4 | 0.5 | 0.3 | 0.3 |
| | | Specific surface area of particles | $cm^2/cm^3$ | $1.8 \times 10^5$ | $1.6 \times 10^5$ | $1.6 \times 10^5$ | $1.2 \times 10^5$ | $1.8 \times 10^5$ | $1.8 \times 10^5$ |
| | Grease composition | Worked penetration | — | 310 | 322 | 311 | 316 | 305 | 318 |
| Evaluation result | Friction coefficient reducing effect | Rate of reduction relative to reference friction coefficient | — | A | B | A | A | B | B |

TABLE 2

| Component (unit) | | | | Comparative Example 1 | 2 | 3 | 4 |
|---|---|---|---|---|---|---|---|
| Grease composition | Base oil (A) | Base oil (A1) | % by mass | 93.5 | 91.0 | 93.0 | 91.0 |
| | | Base oil (A2) | % by mass | — | — | — | — |
| | Thickener (B) | Urea-based thickener (B1) | % by mass | — | — | — | — |
| | | Urea-based thickener (B2) | % by mass | 6.5 | — | — | — |
| | | Urea-based thickener (B3) | % by mass | — | 7.0 | — | — |
| | | Thickener (B') | % by mass | — | — | 7.0 | 7.0 |
| | Polymer compound (C) | Polymer compound (C1) | % by mass | — | — | — | 2.0 |
| | | Polymer compound (C2) | % by mass | — | — | — | — |
| | | Polymer compound (C3) | % by mass | — | — | — | — |
| | | Polymer compound (C4) | % by mass | — | — | — | — |
| | | Polymer compound (C') | % by mass | — | 2.0 | — | — |
| Total | | | % by mass | 100.0 | 100.0 | 100.0 | 100.0 |
| Content ratio [(B)/(C)] | | | — | — | 3.5 | — | 3.5 |
| Physical property value | Base oil (A) | 40° C. Kinematic viscosity | $mm^2/s$ | 30 | 30 | 30 | 30 |
| | | Viscosity index | — | 135 | 135 | 135 | 135 |
| | Thickener (B) | Arithmetic average particle diameter of particles | μm | 0.4 | 0.5 | 2.1 | 2.1 |
| | | Specific surface area of particles | $cm^2/cm^3$ | $1.6 \times 10^5$ | $1.2 \times 10^5$ | $3.0 \times 10^4$ | $3.0 \times 10^4$ |
| | Grease composition | Worked penetration | — | 302 | 304 | 308 | 314 |

TABLE 2-continued

| Component (unit) | | | | Comparative Example 1 | 2 | 3 | 4 |
|---|---|---|---|---|---|---|---|
| Evaluation result | Friction coefficient reducing effect | Rate of reduction relative to reference friction coefficient | — | Reference | C | Reference | C |

It was found from the results shown in Tables 1 to 2 that the grease compositions of Examples 1 to 6 showed a rate of reduction of friction coefficient relative to the reference friction coefficient (rate of reduction of friction coefficient) of 45% or more and thus were superior in reduction of friction coefficient under the test conditions of a low speed and a low load.

On the other hand, the grease compositions of Comparative Example 2 containing the polymer compound (C') which had a molecular weight distribution (Mw/Mn) of 2.28 and or the grease compositions of Comparative Example 4 in which the particles contained in the thickener (B') did not satisfy the requirement (I) showed a rate of reduction of friction coefficient relative to the reference friction coefficient (rate of reduction of friction coefficient) less than 45% and thus, the friction coefficient was not sufficiently reduced under the test conditions of a low speed and a low load.

REFERENCE SIGNS LIST

1: Grease manufacturing apparatus
2: Container body
3: Rotor
4: Introduction portion
4A, 4B: Solution introducing pipe
5: Retention portion
6: First concave-convex portion
7: Second concave-convex portion
8: Discharge portion
9: First concave-convex portion on the side of container body
10: Second concave-convex portion on the side of container body
11: Discharge port
12: Rotation axis
13: First concave-convex portion of rotor
13A: Concave portion
13B: Convex portion
14: Second concave-convex portion of rotor
15: Scraper
A1, A2: Gap

The invention claimed is:

1. A grease composition, comprising:
a base oil;
a urea-based thickener comprising a diurea compound; and
a polymer compound comprising an ethylene-propylene copolymer or an ethylene-butylene copolymer,
wherein the diurea compound of the urea-based thickener has formula, $R^1$-NHCONH-$R^3$-NHCONH-$R^2$, where $R^1$ and $R^2$ are each independently a hydrocarbon group having 6 to 18 carbon atoms, $R^3$ is a diphenylmethylene group, and the urea-based thickener is in an amount in a range of 4.0% by mass to 7.0% by mass based on a total amount of the grease composition, particles that comprise the urea-based thickener have an arithmetic average particle diameter on an area basis as measured by a laser diffraction/scattering method of 2.0 μm or less, and the polymer compound has a number average molecular weight of 30,000 or more and a molecular weight distribution of 2.20 or less and is in an amount in a range of 1.0% by mass to 2.3% by mass based on the total amount of the grease composition.

2. The grease composition according to claim 1, wherein the particles that comprise the urea-based thickener have a specific surface area as measured by a laser diffraction/scattering method of $0.5\times10^5$ $cm^2/cm^3$ or more.

3. The grease composition according to claim 1, wherein the polymer compound comprises the ethylene-propylene copolymer.

4. The grease composition according to claim 3, wherein the ethylene-propylene copolymer has an ethylene content in a range of 40% by mass to 60% by mass based on the total amount of the ethylene-propylene copolymer.

5. The grease composition according to claim 1, wherein the base oil has a 40° C. kinematic viscosity of 10 $mm^2/s$ to 150 $mm^2/s$.

6. The grease composition according to claim 1, wherein a content of the urea-based thickener to the polymer compound is a mass ratio in a range of 1.0 to 4.5.

7. The grease composition according to claim 1, wherein the grease composition has a worked penetration of 250 to 350.

8. A lubrication method, comprising:
lubricating a sliding mechanism in which a metal material and a resin material slide on each other with the grease composition of claim 1.

9. A grease composition, comprising:
a base oil;
a urea-based thickener; and
a polymer compound,
wherein particles that comprise the urea-based thickener have an arithmetic average particle diameter on an area basis as measured by a laser diffraction/scattering method of 2.0 μm or less, the polymer compound has a number average molecular weight of 30,000 or more and a molecular weight distribution of 2.20 or less, and the urea-based thickener is present in an amount in a range of 1.0% by mass to 6.5% by mass based on a total amount of the grease composition.

10. The grease composition according to claim 2, wherein the polymer compound comprises the ethylene-propylene copolymer.

11. The grease composition according to claim 10, wherein the ethylene-propylene copolymer has an ethylene content in a range of 40% by mass to 60% by mass based on the total amount of the ethylene-propylene copolymer.

12. The grease composition according to claim 2, wherein the base oil has a 40° C. kinematic viscosity of 10 $mm^2/s$ to 150 $mm^2/s$.

13. The grease composition according to claim 2, wherein a content of the urea-based thickener to the polymer compound is a mass ratio in a range of 1.0 to 4.5.

14. The grease composition according to claim 2, wherein the grease composition has a worked penetration of 250 to 350.

15. The grease composition according to claim 2, wherein the urea-based thickener is present in an amount in a range of 4.0% by mass to 6.5% by mass based on the total amount of the grease composition.

16. The grease composition according to claim 1, wherein the urea-based thickener is present in an amount in a range of 5.2% by mass to 7.0% by mass based on the total amount of the grease composition.

17. The grease composition according to claim 1, wherein the base oil is present in an amount in a range of 91.0% by mass to 95.0% by mass based on the total amount of the grease composition.

18. The grease composition according to claim 1, wherein the base oil is present in an amount in a range of 91.0% by mass to 92.8% by mass based on the total amount of the grease composition.

19. The grease composition according to claim 1, wherein $R^1$ and $R^2$ each independently are a cyclohexyl group, an octadecyl group or an octyl group.

20. The grease composition according to claim 1, wherein a content of the urea-based thickener to the polymer compound is a mass ratio in a range of 2.6 to 3.5.

* * * * *